US008529029B2

(12) United States Patent
Szusdziara et al.

(10) Patent No.: US 8,529,029 B2
(45) Date of Patent: Sep. 10, 2013

(54) INKJET PRINTER TO PRINT TO A RECORDING MATERIAL

(75) Inventors: Thomas Szusdziara, Markt Schwaben (DE); Andreas Mueller, Baldham (DE); Murat Kader, Munich (DE)

(73) Assignee: Océ Printing Systems GmbH, Poing (DE)

( * ) Notice: Subject to any disclaimer, the term of this patent is extended or adjusted under 35 U.S.C. 154(b) by 8 days.

(21) Appl. No.: 13/310,968

(22) Filed: Dec. 5, 2011

(65) Prior Publication Data

US 2012/0140003 A1 Jun. 7, 2012

(30) Foreign Application Priority Data

Dec. 3, 2010 (DE) ..... 10 2010 061 001

(51) Int. Cl.
*B41J 2/175* (2006.01)

(52) U.S. Cl.
USPC ..... 347/85

(58) Field of Classification Search
USPC ..... 347/84, 85, 86, 87, 92
See application file for complete search history.

(56) References Cited

U.S. PATENT DOCUMENTS

| | | | | |
|---|---|---|---|---|
| 5,963,236 | A * | 10/1999 | Miyashita et al. | 347/85 |
| 6,863,386 | B2 | 3/2005 | Hatada et al. | |
| 7,182,444 | B2 * | 2/2007 | Kawamoto | 347/85 |
| 2005/0046682 | A1 | 3/2005 | Kawamoto | |
| 2008/0273046 | A1 | 11/2008 | Ishinaga et al. | |

FOREIGN PATENT DOCUMENTS

| | | | |
|---|---|---|---|
| JP | 2002 113342 | A2 | 4/2002 |
| WO | 2008094859 | A1 | 8/2008 |

* cited by examiner

*Primary Examiner* — Anh T. N. Vo
(74) *Attorney, Agent, or Firm* — Schiff Hardin LLP

(57) ABSTRACT

In an inkjet printer at least one print head is provided via which ink droplets are ejected onto a recording material. An intermediate ink container supplies ink for the print head. A pumping device pumps ink which is then supplied into the intermediate ink container at an ink inlet from the pumping device. At least one current director is arranged at a distance from a floor within a region of the intermediate ink container and is angled such that ink flowing out of the ink inlet from the pumping device flows in a radial direction at an angle of inclination and is deflected by the floor or a container wall of the ink container such that an ink current is generated via which a stirring of the ink occurs.

7 Claims, 4 Drawing Sheets

INKJET PRINTER TO PRINT TO A RECORDING MATERIAL

BACKGROUND

The disclosure concerns an inkjet printer to print to a recording material, in particular a high-speed printer for printing web-shaped recording materials or individual pages.

In inkjet printers, print images are printed onto a recording material via targeted ejection of ink droplets or a continuous ink stream. For this a hydraulic pressure is generated in a print head that is provided with one or more ink nozzles, whereby ink droplets or the ink stream are/is ejected from respective nozzle channels. In inkjet printers it is typical that the print head moves relative to the recording material during the printing. For this the print head and/or the recording material can be moved accordingly.

The ink for printing is drawn from a reservoir and is possibly supplied via one or more intermediate containers to the print head or heads. The ink in the print head is placed under high pressure so that the ink droplets or the ink stream can be ejected. Such strong pressure fluctuations can trigger cavitation. Small gas bubbles are thereby formed. Since gas bubbles are compressible in the print generation, a reproducible droplet formation or stream formation is then no longer ensured. The ink should therefore be largely degassed before being supplied to the print head.

A degassing device is known from the document WO 2006/029236 A1. The ink to be degassed is thereby drawn from an intermediate container, degassed and supplied again to the intermediate container. The gas that arises is discharged. During the extraction of the ink, the ink can be mixed with the aid of a stirrer (an agitator) so that no regions with increased amounts of degassed ink and increased amounts of ink that has not been degassed form in the ink. The goal is that optimally little gas is dissolved in the ink as soon as it arrives at the print head.

However, the degassing in the known device is conducted only during print pauses. During this time period only the stirring process also proceeds. It is thus prevented there that the ink droplet generation is not negatively affected. However, if printing takes place continuously, or if long print jobs are printed—as is typical in high-capacity printers—it can occur that ink is not effectively degassed, and therefore unwanted cavitation can form.

A mixing device for an ink container in which a conventional stirrer should be replaced is known from the document U.S. Pat. No. 6,863,386 B2. To mix the components of the ink that are filled into the ink container, an inlet nozzle is arranged angled by 90° to the floor of the container. An outlet opening is arranged on the floor, downstream of an ink flow generated by the nozzle. To mix the ink, a pump is activated that draws the ink via the outlet opening and ejects the ink approximately horizontally and approximately tangential to the container edge via the inlet nozzle. A circular flow is thereby created. After the ink is uniformly mixed, it can be conducted to a filter or directly to a print head. With such a device the ink is essentially stirred only in a horizontal plane, but not the entirety of the ink in the container.

SUMMARY

It is an object to achieve an ink printer to print a recording material with which printer larger or longer print jobs can also be printed with uniformly high print quality. In particular, the entirety of the ink located in an ink container should be effectively degassed before it is conveyed to the print head.

In an inkjet printer at least one print head is provided via which ink droplets are ejected onto a recording material. An intermediate ink container supplies ink for the print head. A pumping device pumps ink which is then supplied into the intermediate ink container at an ink inlet from the pumping device. At least one current director is arranged at a distance from a floor within a region of the intermediate ink container and is angled such that ink flowing out of the ink inlet from the pumping device flows in a radial direction at an angle of inclination and is deflected by the floor or a container wall of the ink container such that an ink current is generated via which a stirring of the ink occurs.

DESCRIPTION OF THE PREFERRED EMBODIMENTS

Figure 1:
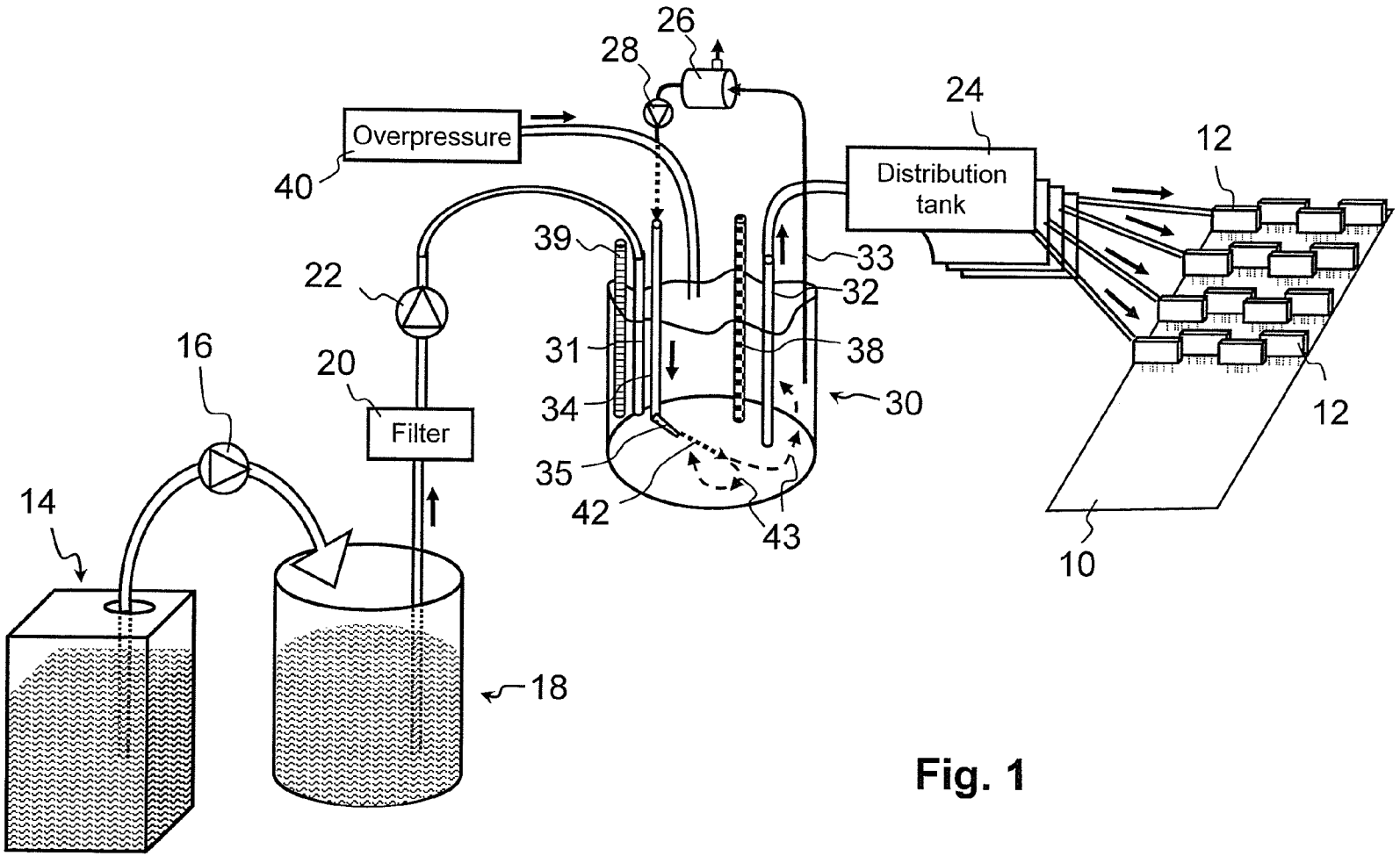
FIG. 1 is a schematic design of the inkjet printer.

For the purposes of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included.

The inkjet printer has an intermediate ink container from which ink is drawn for printing. So that the ink is largely degassed, fresh ink is supplied radially inward and at an angle of inclination near the floor of the container. For this the inlet opening of an ink inlet from a degassing inlet is arranged decentrally and near the floor. The end of the ink inlet from the degassing inlet is designed so that the degassed ink flowing out of the inlet flows at an angle counter to the floor and/or the container wall of the intermediate ink container and then divides into two partial currents that flow in the peripheral direction and upward at an angle. The total volume of the ink in the intermediate ink container is thus encompassed by the current. The supplied, degassed ink is thereby stirred with ink located in the container. The degree of degassing of the total ink in the container is therefore increased on average.

It is advantageous that the degassed ink flowing in strikes the flow in the direction of its center at an angle of inclination of approximately 20°-50° relative to said floor. The angle of inclination is advantageously between 40 and 45°. It is also advantageous if the inlet opening of the ink inlet from the degassing inlet is arranged decentrally between container wall and the center point of the container, and that the opening points in the direction of the center point.

It is additionally advantageous if the ink outflow is situated in the region of the current of degassed ink so that largely degassed ink is optimally supplied to the ink heads.

Exemplary embodiments are explained in detail in the following using the schematic drawings.

According to FIG. 1, an inkjet printer for printing to a recording material 10 has one or more print heads 12. A print head 12 has one or more nozzles via which ink droplets are ejected as needed in the direction of the recording material 10 via generation of hydraulic pressure in the print head 12. In high-capacity printers, these print heads 12 are typically arranged stationary over the entire width of the recording material 10 (i.e. transverse to the transport direction of the recording material 10) while the recording material 10 moves through below the print heads 12. The print heads thus respectively generate a print line for a respective color to be printed.

A single print head 12 can extend over the entire width of the recording material 10. Multiple print heads 12 can also be connected into what is known as a print bar, which print heads then respectively generate one print line transverse to the transport direction of the recording material 10. In the exemplary embodiment according to FIG. 1, four print heads 12 form a print bar. One color (for example yellow, magenta, cyan and black; YMCK) can respectively be printed with each print bar. For a simpler representation in FIG. 1, only the ink supply of one print bar is shown. Only one color is printed with this print bar. For security two print bars can also be present in parallel, wherein ink is only ejected via the nozzles of the second print bar if a corresponding nozzle of the first, parallel print bar for the same print point is blocked, or if a print point should require more than the typical amount of ink.

The number of print heads 12 and nozzles located in these (and possibly parallel print heads that are slightly offset from these) define the resolution with which such a print head 12 or print bar can print.

Fresh ink is drawn from an exchangeable ink reservoir 14 and is conveyed into a buffer container 18 with the aid of a pump 16.

The ink is pumped as needed (across a filter 20 via which contamination particles are filtered out) with the aid of an additional pump 22 into an intermediate ink container 30 whose ink level is largely maintained at a predetermined level/fill level. The ink is then later supplied as needed from this intermediate ink container 30 via a distribution tank 24 to the individual print heads 12 for printing.

Sufficient ink in order to be able to continue the printing process even while the empty intermediate ink container 14 is exchanged for a full one should always be present in the buffer container 18.

A pipe network or hose network that is composed of rigid pipes and/or flexible hoses serves to convey the ink. In the following essentially only "pipe" and "pipe-shaped" are used, even if the matter should also deal with a flexible hose.

Known connections (such as sleeve connections, screw connections or molded parts) serve to connect pipes or hoses. Armatures—valves and sliders, for example—serve as cutoff and control devices. The ink is then always conveyed from one station to the next when the corresponding demand exists, i.e. in the event that ink either falls below an ink level 41 (level; see dotted, circular line in FIG. 2) or that insufficient ink would be available in the event that further printing would take place without ink transport.

According to the exemplary embodiment according to FIG. 1, fresh ink is supplied to the intermediate ink container 30 via a pipe-shaped ink inlet 31 (supply pipe or hose to the intermediate ink container 30). The ink is drawn from the intermediate ink container 30 as needed and is supplied to the individual print heads 12 via the distribution tank 24.

So that no cavitation (vapor bubbles) form later in the print heads 12 during the ink droplet generation, ink is continuously drawn from the intermediate ink container 30, degassed in a degassing device 26, and supplied again to the intermediate ink container 30 via a degassing pump 28. The ink is thereby continuously conveyed into a degassing circuit and streamed through the degassing device 26, whereby the gases are released from the ink (i.e. the ink is degassed). The released gas can be discharged externally. In order to draw the ink from the intermediate ink container 30 for degassing and to supply it back, an ink outlet to a degassing outlet 33 (outputting to the degassing device 26) or ink inlet from a degassing inlet 34 (outputting into the intermediate ink container 30) are arranged from and to the degassing device 26.

According to the preferred exemplary embodiment, the degassed ink outlet 34 is utilized to effectively stir the ink in the intermediate ink container 30 via constructive design, and thereby to increase the degree of degassing on average. For this the ink inlet end 35 from degassing inlet 34 is designed as a flow director such that for the outflowing ink a radial primary current 42 is created on the one hand and partial currents 43 in the circumferential direction are created on the other hand (via deflection at the floor 45 and/or on the lateral container wall 46) such that a total current in the intermediate ink container 30 is created via which the entirety of the ink in the intermediate ink container 30 is ultimately encompassed and stirred with the degassed ink. The further the current flows, the more volume the current affects to stir the ink. The current is slower, however.

This provides for a blending of the supplied, degassed ink with the ink already located in the intermediate ink container 30. Via a continuous degassing, the degree of degassing in the intermediate ink container 30 is high and the ink is kept in motion.

In particular in high-capacity printers with print speeds of more than 0.5 m/s, a great deal of ink is consumed for printing, such that ink is continuously drawn from the intermediate ink container 30 and fresh ink must be resupplied. This requires a significant use of the degassing device, such that a great deal of degassed ink flows through the intermediate ink container. This has the result that the ink in the intermediate ink container 30 is also continuously stirred.

In the first exemplary embodiment, at least the end 35 of the pipe-shaped ink inlet from degassing inlet 34 that is located in the ink in the intermediate ink container 30 is arranged in proximity to the floor 45 of said intermediate ink container 30, and has an angle of inclination a between 20° and 50° relative to the floor 45. If ink flows through the ink inlet from degassing inlet 34, the inlet end 35 of the ink inlet from degassing inlet 34 acts as a current director that imparts a desired current direction to the outflowing ink.

This generates a developing ink current that initially travels radially inward and downward as an approximately laminar current. It strikes the floor 45 at an angle and is deflected from there upward and towards the container wall 46. There the current is essentially divided into two partial currents 43 that are deflected upward and in the circumferential direction. More eddies arise due to the current in the circumferential direction, and the current increasingly transitions into an unorganized, turbulent current. It thus encompasses a large volume of the ink in the intermediate ink container 30.

So that the desired current 42, 43 arises, the inlet end 35 of the ink inlet from degassing inlet 34 is tilted at an angle of inclination of approximately 20° to 50° relative to the floor 45 so that the ink flows out of the opening of the ink inlet from degassing inlet 34 at such an angle of inclination.

The ink in the intermediate ink container 30 is thereby continuously kept in motion, and in addition to this degassed ink is whisked or stirred (largely homogenized) with ink already located in the intermediate ink container 30. If the ink continuously flows through the ink inlet from degassing inlet 34, the ink in the intermediate ink container 30 becomes increasingly more degassed or is always degassed again (even if no ink is drawn for the ink heads 12).

Since, given contact with air, gases can again be incorporated into the ink after longer downtime, the ink must at least largely be continuously degassed. Namely, it is to be avoided that ink that is not degassed or that is only slightly degassed arrives at the print head 12. Before the beginning of the printing, after a very long downtime (for example given downtime over a weekend) the ink should initially be degassed in the intermediate ink container 30.

The degassing device 26 should be active not only during the printing but also during print pauses and during the cleaning of the print heads 12. In the cleaning, either the print heads 12 are moved into a cleaning position (not shown) or the print heads 12 can remain approximately in their "write position". A cap (not shown) that serves as a protection and capture basin for ink can then be driven over the nozzle openings. Ink from the intermediate ink container 30 is then flushed through the nozzle channels so that a blockage of the nozzle channels as a result of an increase of the ink viscosity in the downtime (given longer non-use of the nozzle) is prevented and the nozzle channels are cleaned. Particles that are possibly present, or solidifying ink clumps that could block or constrict the nozzles, are flushed out.

Ink can also be sucked from the nozzle channels or be pushed into these in order to remove possible contaminations of the channels.

Due to the ultimately turbulent current, a stirring of the ink takes place without a stirrer or whisk being required.

An additional heating device (not shown) that tempers the ink as needed can optionally be arranged in the intermediate ink container 30 so that tempered ink can be supplied to the print head 12. A temperature sensor 38 is arranged in the intermediate ink container 30 to regulate the temperature, which temperature sensor 38 measures the temperature of the ink and communicates it to a control device (not shown). From there the heating device 37 is controlled accordingly so that the ink that then arrives at the print head 12 already has a corresponding temperature and viscosity. It is advantageous when the heating device and the temperature sensor 38 are arranged so that they are well washed by the generated current.

The ink can also be heated in a distribution tank 24. The heating in the intermediate ink container 30 can then be omitted. Due to the corresponding temperature, the viscosity of the ink is located within a good range so that the print quality is optimized.

Moreover, a fill level sensor 39 is arranged in the intermediate ink container 30, which fill level sensor 39 measures the fill level and—given too small a quantity of ink (ink level 41 falls below limit value)—induces fresh ink to be supplied via the buffer container 18. Sufficient ink must always be present in the intermediate ink container 30. This ink should advantageously already be largely degassed before it is supplied to the print head 12 in order to prevent any print quality losses from being suffered as a result of unintended cavitation. The arrows in the Figures show the respective flow directions of the ink.

The ink in the intermediate ink container 30 is under overpressure so that the ink can be transported to the print heads 12 with sufficient pressure. The overpressure of approximately 0 to 2 bar is generated by an overpressure device 40. If ink is pumped from the intermediate ink container 30 to the print heads 12 for the purposes of cleaning the nozzles, purging or filling the print heads 12, this occurs with overpressure (up to 2 bar). Atmospheric pressure (approximately zero bar) prevails in the intermediate ink container 30 during the printing operation.

In the print heads 12 themselves the ink is under negative pressure (during downtime or during the printing operation) so that a leakage or unintentional outflow from the print head 12 or the nozzle channel is prevented, since otherwise the print image could be degraded due to unwanted escaping ink droplets, or the droplets could undesirably dry outside of the nozzle channel. This negative pressure is established in that the ink level 41 in the intermediate ink container 30 is below (in terms of its height) the ink level in the print head 12. The intermediate ink container 30 is therefore also designated as a "backpressure tank".

Figure 2:
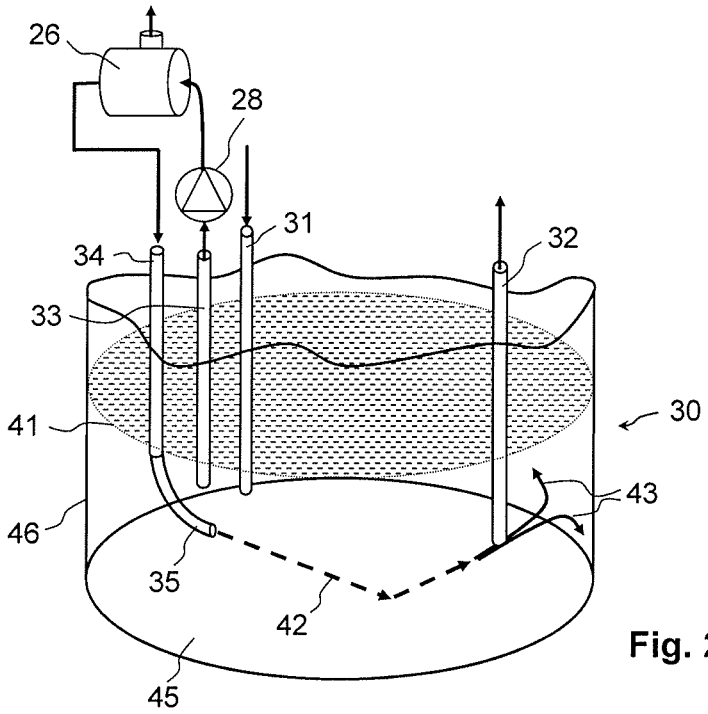
FIG. 2 is an intermediate ink container and a degassing device of the inkjet printer according to FIG. 1.

An exemplary embodiment is shown in FIG. 2, in which the fresh ink is supplied from above into the intermediate ink container 30 via the ink inlet 31 from the buffer container 18. It is hereby advantageous if the ink inlet 31, the ink outlet to degassing outlet 33 and the ink inlet from degassing inlet 34 are arranged near to one another, and the opening of the ink outlet 32 is arranged in the region of the primary current 42 or a partial current 43. At least a portion of the freshly supplied ink can thus be drawn via the ink outlet to degassing outlet 33 and can be supplied to the degassing device 26 for degassing. The opening of the ink outlet 32 lies diametrically opposite the opening of the ink inlet from degassing inlet 34, and therefore advantageously in the region of the primary current 42.

The degassed ink is conveyed via the degassing pump 28 to the ink inlet from degassing inlet 34 and flows out from this with corresponding velocity, quantity per time and direction. Due to the current 42, 43 of the degassed ink, this arrives quickly at the ink outlet 32 for distribution tank 24. In the event that ink is conveyed to the print heads 12, essentially degassed ink is thus conveyed.

Since the degassing circuit via the degassing device 26 is advantageously continuously active, degassed ink is continuously conducted into the intermediate ink container 30; there it is deflected accordingly in a desired direction via the embodiment of the degassing intake, such that a stirring takes place.

The inlet end 35 can be bent, arc-shaped or designed in a curve. The opening points approximately in the direction of the center axis 48 (see FIGS. 4 and 5) of the intermediate ink container 30. The ink thus flows at the angle of inclination a in this direction. Since the inlet end 35 is designed at an angle relative to the floor 45, the ink initially flows at an angle in the direction of the floor 45. There the current is deflected upward towards the side wall and essentially divides into two partial currents 43 that in turn continue to flow inward and angled upward. The current thereby becomes increasingly turbulent.

The ink circulates continuously through the degassing device 26, and degassed ink flows continuously through the opening in order to maintain a current in the intermediate ink container 30; and a stirring takes place of the supplied, degassed ink with the (possibly) freshly supplied ink and the ink located in the intermediate ink container 30. The ink is thus largely degassed bit by bit in the intermediate ink container 30 and is also kept in a largely degassed state. Since the intermediate ink container 30 is open at the top and is in contact with air, it is important that the ink is continuously degassed, since otherwise gases can again dissolve into the ink over the course of time due to contact with the air.

Since degassed ink is always added again and ink is continuously drawn from the intermediate ink container 30, the degree of degassing of the ink in the intermediate ink container is increased and the ink is homogenized. In the event that the ink contains necessary particles such as color pigments or MICR particles (magnetizable metal particles that are machine-readable), these particles are distributed uniformly in the ink so that the ink to be printed is homogenized (i.e. is stirred well). Color pigments or dye particles cannot accumulate, such that these exist well distributed in the ink and no color intensity fluctuations take place as a result of insufficient stirring. The particles thus also do not settle and do not block any pipes since they are distributed well in the ink, and clumps do not arise in the first place, or are dissolved.

The higher the outflow speed at the opening of the ink inlet from degassing inlet 34, the more intensively and faster that the ink is stirred in the intermediate ink container 30. The same also applies the more ink that flows from the ink inlet from degassing inlet 34 per time unit. The outflow speed can be set by the diameter of the degassed ink supply flow at the ink inlet from degassing inlet 34 and the capacity of the degassing pump 28. It is also independent of the ink consumption (i.e. the quantity of ink that must be resupplied) so that the ink level 41 remains largely constant.

Figure 3:
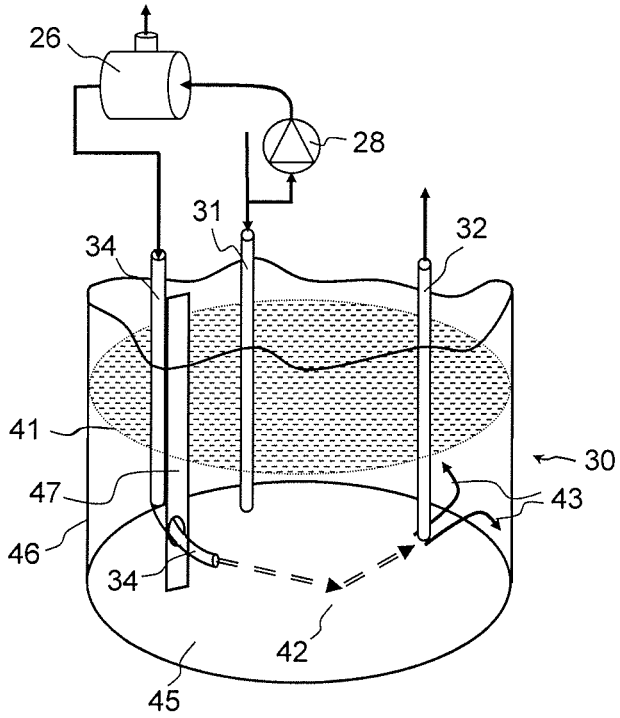
FIG. 3 is an additional exemplary embodiment of the intermediate ink container and the degassing device.

An additional exemplary embodiment is shown in FIG. 3, in which—in contrast to the exemplary embodiment according to FIG. 2—fresh ink is supplied from the buffer container 18 directly to the degassing device 26. Only the degassed ink is then supplied to the intermediate ink container 30. However, for safety reasons an overpressure compensation can occur in the event that more fresh ink than can be degassed must be supplied. A portion of the fresh ink then passes directly into the intermediate ink container 30 via the ink inlet 31. The same applies when more ink is used for printing than can be fed from the degassing device 26 into the intermediate ink container 30. Before the ink reservoir in the intermediate ink container 30 runs low and printing cannot be continued, it is accepted that fresh ink that has not been degassed is supplied directly via the ink inlet 31 into the intermediate ink container 30.

The degassing supply flow inlet 34 can—as shown in FIG. 3—be designed as a flexible tube (for example a silicone hose). In order to obtain the corresponding shape and current direction, a mount 47 can be provided that has an eye through which the inlet end 35 of the ink inlet from degassing inlet 34 is threaded. The mount 47 holds the ink inlet from degassing inlet 34 and its inlet end 35 in its position with the desired inclination. If the ink inlet from degassing inlet 34 is produced from rigid material, such mounts are not absolutely necessary; however, it can also be used in order to keep the ink inlet from degassing inlet 34 securely in its position. Fluctuations and kickback motions that are damped with the mount 47 can arise due to the ejection of the ink.

Figure 4:
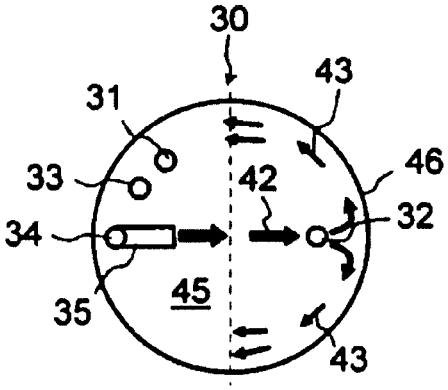
FIG. 4 is a plan view of the intermediate ink container according to FIG. 2.
Figure 5:
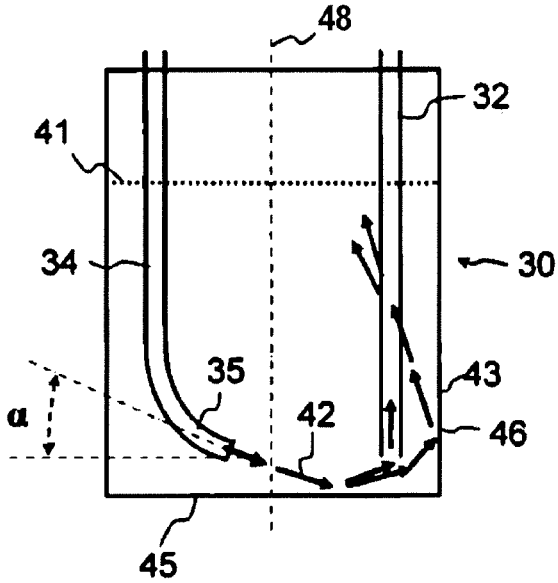
FIG. 5 is a schematic section presentation of the intermediate ink container according to FIG. 2.

As shown in FIGS. 4 and 5, the current generated by the in-flowing, degassed ink is initially essentially a primary current that is directed radially inward, approximately through the center axis 48 (horizontal axis in a cylindrical intermediate ink container 30; see FIG. 5, in which is shown a section through the center axis 45 through the intermediate ink container 30), and downward. After the deflection at the floor 45 and/or at the container wall 46, the ink flows upward in essentially two partial currents 43. While the primary current 42 still flows in a largely laminar manner, the partial currents 43 behave increasingly turbulent and travel upward. A total current is thus generated that stirs the entirety of the ink in the intermediate ink container 30.

The ink that is suctioned from the print heads 12 is essentially suctioned in the region of the primary current 42 via the ink outlet 32. For this the opening of the ink outlet 32 is advantageously arranged in the region of the primary current. There the concentration of degassed ink is still particularly high since a stirring with the ink located in the intermediate ink container 30 has barely occurred.

The primary current 42 initially flows at an angle downward with an angle of inclination a of approximately 20° to 50° at the floor 45 of the intermediate ink container 30. A particularly effective stirring of the ink is achieved if the angle of inclination a amounts to approximately 40° and 45°. The total current then better encompasses the total volume of the ink after the deflections at the floor 45 and the container wall 46.

An additional influencing variable is the region in which the primary current 42 impacts the floor 45 and then is deflected at the container wall 46. The stirring is particularly effective when the opening of the ink inlet from degassing inlet 34 is arranged approximately in the middle between the center axis 48 and the container wall, and the primary current 42 impacts the floor 45 at a diametrically opposite location, for instance in the middle between the center axis 48 and the opposite container wall.

The opening of the ink inlet from degassing inlet 34 in the intermediate ink container 30 is ideally located at a distance of only a few centimeters from the floor 45 of the intermediate ink container 30 given a container diameter of approximately 10 cm.

The ink inlet from degassing inlet 34 can have a nozzle-like design (tapering or expanding) of the opening in order to allow the current to impact the floor 45 only as a laminar stream, or more broadly scattered, so that the desired current (and therefore the stirring) is even more efficiently achieved.

It is advantageous if the opening of the ink inlet from degassing inlet 34 is arranged entirely within the ink and at a relatively small distance from the floor 45. The current 42, 43 is then not too severely weakened on its path to the floor 45, and finally to the container wall 46.

The ink inlet from degassing inlet 34 is advantageously designed as one piece. The transition from the vertical region of the ink inlet from degassing inlet 34 to the pipe-shaped inlet end 35 should proceed steadily and continuously so that the discharge is as negatively affected as little as possible.

It is advantageous if the opening of the ink outlet 32 is arranged in the region of a strong current of the degassed ink. It is thus ensured that primarily degassed ink flows around the opening of the ink outlet 32. As soon as ink is conveyed to the print heads 12, essentially degassed ink is thus conveyed. It is likewise advantageous if the ink inlet 31 (insofar as it is arranged in the intermediate ink container 30) is arranged near the ink outlet to degassing outlet 33 so that the fresh ink supplied to the intermediate ink container 30 can also be equally degassed.

From a production standpoint, it is advantageous if the ink inlet from degassing 34 is designed as a straight pipe and protrudes into the intermediate ink container 30 (open at the bottom). A curvature that is complicated to produce is then avoided. However, a baffle (not shown) is then required that imparts a corresponding current direction to the flowing ink. Given corresponding inclination and rotation position of the baffle, the outflowing ink that strikes the baffle is directed onto the floor 45 and/or against the container wall 46, and from there upward in the circumferential direction.

The ink inlet from degassing inlet 34 can be supplied to the intermediate ink container 30 from below, laterally or from above. It is important that the outflow direction of the ink is angled from the opening of the ink inlet from degassing inlet 34 with an angle of inclination a towards the floor 45 of the intermediate ink container 30. The ink first flows against the floor 45 (or a possibly present baffle) and is then deflected upward, such that a more or less turbulent current arises.

Since only degassed ink is locally introduced into the intermediate ink container 30 via the ink inlet from degassing inlet 34 (an increased concentration then exists there), the degassed ink is distributed uniformly in the intermediate ink container 30 via the generated ink current. A sedimentation of pigments or other particles (solid contents of the ink) is also prevented by the ink current. The ink is continuously kept in motion. A separation of the ink is prevented by the motion/current.

If the degassing device 26 is continuously active, a very low air content (normally oxygen) is achieved in the ink (less than 1 mg/l) as a result of the stirring in the intermediate ink container 30.

The exemplary embodiment is presented in the drawing Figures using only a single ink color. In the event that printing takes place in color—for example with the colors YMCK or RGB (red, yellow, blue) and black as well—a separate ink circuit with all elements that have previously been described for only one color is thus present for each color. Three additional distribution tanks 24 for three additional colors are shown as indicated in FIG. 1. These are connected with a respective print bar comprised of one or more respective print heads 12. Four to six print heads are advantageously used given a print width of approximately 540 mm.

What is to be understood by the terms "pipe-shaped ink outlet to degassing" outlet 33 or "pipe-shaped ink inlet from degassing" inlet 34 is an oblong hollow body whose length is normally significantly greater than its cross section. A pipe or a hose can be used as a hollow body. In contrast to a hose, a tube can be made of a relatively rigid material (for example of metal). Pipes and hoses generally have a round cross section. The cross section can have a rectangular, oval or other shape.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

We claim as our invention:

1. An inkjet printer for printing to a recording material, comprising:

at least one print head via which ink droplets are ejected under pressure onto a recording material;

an intermediate ink container from which ink is supplied as needed to the print head;

a pumping device that supplies pumped ink, and after pumping by the pumping device said ink is supplied into the intermediate ink container via an ink inlet from the pumping device;

at least one current director arranged at a distance from a floor within a region of the intermediate ink container filled with said ink and which is angled downwardly toward the floor such that ink flowing out of the ink inlet from the pumping device initially flows in a radial direction at an angle of inclination defining a downward slope towards the floor and when striking the floor is deflected upwardly by the floor and thereafter is deflected by a container wall of the intermediate ink container such that an ink current in the intermediate ink container is generated via which a stirring of the ink in the intermediate ink container occurs.

2. An inkjet printer for printing to a recording material, comprising:

at least one print head via which ink droplets are ejected under pressure onto a recording material;

an intermediate ink container from which ink is supplied as needed to the print head;

a pumping device that supplies pumped ink, and after pumping by the pumping device said ink is supplied into the intermediate ink container via an ink inlet from the pumping device;

at least one current director arranged at a distance from a floor within a region of the intermediate ink container filled with said ink and which is angled downwardly toward the floor such that said ink flowing out of the ink inlet from the pumping device initially flows in a radial direction at an angle of inclination down toward the floor where said ink is deflected upwardly by the floor toward a container wall of the intermediate ink container such that an ink current in the intermediate ink container is generated via which a stirring of the ink in the intermediate ink container occurs; and said pumping device comprises a degassing device having a degassing pump, and wherein said ink inlet from said pumping device comprises an ink inlet from a degassing inlet.

3. The inkjet printer according to claim 2 wherein the angle of inclination is between 20° and 50° relative to the floor of the intermediate ink container.

4. The inkjet printer according to claim 3 wherein a mount is provided which maintains the ink inlet from the degassing inlet in its angled position with an opening at a distance from the floor of the intermediate ink container.

5. The inkjet printer according to claim 2 wherein the ink inlet from the degassing inlet is supplied to the intermediate ink container from below, laterally, or from above.

6. The inkjet printer according to claim 2 wherein an opening of an ink outlet is located in the intermediate ink container, said ink outlet supplying said ink to the print head and being arranged downstream of the generated ink current and diametrically opposite an opening of the ink inlet from said degassing inlet.

7. An inkjet printer for printing to a recording material, comprising:

at least one print head via which ink droplets are ejected under pressure onto a recording material;

an intermediate ink container from which ink is supplied as needed to the print head;

a degassing device that supplies pumped ink, and after pumping by the degassing device said ink is supplied into the intermediate ink container via an ink inlet from the degassing device; and at least one current director arranged at a distance from a floor within a region of the intermediate ink container filled with said ink and is angled downwardly towards the floor such that said ink flowing out of the ink inlet from the pumping device initially flows in a radial direction at an angle of inclination downwardly towards the floor and is then deflected by the floor upwardly and thereafter by a container wall of the intermediate ink container such that an ink current in the intermediate ink container is generated via which a stirring of the ink in the intermediate ink container occurs.

* * * * *